US005515941A

United States Patent [19]

Palmer et al.

[11] Patent Number: 5,515,941

[45] Date of Patent: May 14, 1996

[54] BUILDING ROOF EAVE MOUNTING GUARD STRUCTURES

[76] Inventors: Theodore R. Palmer, Unit #5 10 Pinelands Avenue, Stoney Creek ON, Canada, L8E 3A5; Clifford W. Chaston, 83 McAnulty Blvd., Hamilton Ontario, Canada, L8H 3H2

[21] Appl. No.: 242,331

[22] Filed: May 13, 1994

[51] Int. Cl.[6] ..... E04G 3/12

[52] U.S. Cl. ..... 182/45; 182/113; 52/27

[58] Field of Search ..... 182/45, 113, 150; 248/237; 52/27; 256/DIG. 6, 67, 65

[56] References Cited

U.S. PATENT DOCUMENTS

| | | | |
|---|---|---|---|
| 3,901,481 | 8/1975 | Probst | 256/65 X |
| 4,957,185 | 9/1990 | Courchesne et al. | 182/45 X |
| 5,113,971 | 5/1992 | Violet | 182/45 |

*Primary Examiner*—Carl D. Friedman
*Assistant Examiner*—Kien T. Nguyen
*Attorney, Agent, or Firm*—McConnell and Fox

[57] ABSTRACT

A guard structure for installation at the edge of a building roof eave to assist in shingling employs a plurality of spaced roof cleats nailed to the roof, each having a hinge at its lower end with a hinge axis parallel to the eave. Each hinge connects the cleat to a respective vertical support member at a junction portion immediately adjacent to the eave. The portion of the support member below the eave or roof line engages the building structure, e.g. the rafter tail or fascia board, usually through a pressure plate, and may carry a screw-threaded adjustment member for adjusting the vertical attitude of the support member. The other portion of the support member has a lower outward upward inclined part carrying a toe board retainer member for an inclined toe board, and an upper vertical part carrying at least two vertically spaced back rail support members, as is usually required by safety regulations. The toe board and the back rails form a safety structure for the roofer. Metal safety straps may be provided extending longitudinally beneath the toe boards to prevent catastrophic breakage if they sag excessively. The upper vertical part may also be provided with a retainer for a vertical horizontally extending catch board; when such a catch board is provided it cooperates with the toe board to form a catch space to prevent debris falling from the structure to the ground and also provides an improved safety structure.

20 Claims, 2 Drawing Sheets

BUILDING ROOF EAVE MOUNTING GUARD STRUCTURES

FIELD OF THE INVENTION

This invention provides a new building roof eave mounting guard structure member, and new building roof eave mounting guard structures employing such members. The invention also provides a new building roof eave mounting catch and guard structure member, and new building roof eave mounting catch and guard structures employing such members.

REVIEW OF THE PRIOR ART

When working on building roofs for the purposes of, for example, repairing shingles and removing and replacing shingles, it is desirable to provide some means at the eaves to support the workers and to guard against the possibility of accidentally falling or sliding from the roof to the ground below. The installation of new shingles produces a certain amount of debris, such as dropped nails, broken and part shingles, and it is desirable to ensure that these are gathered easily at specific locations and do not drop to the ground. It is also desirable during the removal of old shingles to gather them in a convenient location or locations where they do not fall randomly to the ground, and from which they can conveniently and quickly be loaded onto a transport for disposal.

It is common of course in all phases of building construction and repair to use various forms of safety and supply scaffold which may be, for example, supported on brackets attached to the building, mounted on ladders, or directly mounted on the ground. The use of ladders is not favoured, since it difficult to provide a safe effective structure, while if the scaffold is directly supported from the ground substantial construction is usually required to raise the scaffold high enough. Much time and effort is usually required in building the scaffold to the proper height, adding considerably to the cost and time taken in completing the job.

It has been proposed in the past therefore to support the scaffold directly from the roof by means of brackets attached to the roof. A typical example of a roof supported scaffold employing such brackets is that shown in U.S. Pat. No. 1,558,425, the brackets being spiked to the roof with the scaffold pinned onto the brackets to adapt to various roof pitches. The structure disclosed does not permit access to the whole of the roof edge since the brackets and the attachment of the support structure interferes with the surface of the roof near the edge. Alternative arrangements are illustrated in U.S. Pat. Nos. 3,158,223 and 4,074,792, both of which show a scaffold supported from the roof, but in which the supports are not attached to the roof, but merely maintain their position by frictional engagement with the roof; in the structure disclosed in the latter patent such frictional engagement may be supplemented by the use of prongs.

A further roof-supported scaffold structure is disclosed in U.S. Pat. No. 4,957,185, comprising a roof cleat that is removably nailed to the roof surface and has a hooked end plate pivoted at its lower end about a horizontal axis. The cleat is installed with the hooked end plate hanging over the roof edge and a vertically extending bracket member is hooked onto it so as to be pivotable about an axis parallel to the roof eave. The part of the bracket member that actually engages the end plate extends above the roof edge and is inclined to the vertical away from the roof, forming a support for a plank constituting a safety foot rest for the roofer. The majority of the vertical bracket member extends a considerable distance below the roof edge and telescopes vertically so that its length can be adjusted; it has at its lower end a horizontally extending member that also telescopes for its length to be adjustable. The inner end of the horizontal member engages the building wall, while its outer end protrudes beyond the vertical bracket member part and supports a horizontal support plank on which the roofer can stand at the side of the building; the outer end also supports parallel to the building wall a safety rail disposed a suitable distance above the support plank. The length of the horizontal member is adjusted with the bracket member pivoting about the pivot axis with the roof cleat until the vertical bracket member is truly vertical and the support plank is truly horizontal.

SUMMARY OF THE INVENTION

It is a principal object of the invention to provide a new building roof eave mounting guard structure member, and new building roof eave mounting catch structures employing such members.

It is another object to provide a new building roof eave mounting catch and guard structure member, and new building roof eave mounting catch and guard structures employing such members.

It is a further object to provide such a structure member and associated structures that are simple and inexpensive both to manufacture and to install, assisting in ensuring that they will be used by roofers, especially with relatively small jobs where cost is a prime consideration.

In accordance with the invention there is provided a building roof eave mounting guard structure member for installation at the edge of a building roof eave comprising:

a roof cleat comprising a flat apertured metal plate removably fastenable to the roof by at least one nail passing through respective plate apertures into the roof;

the roof cleat having at its end that is its lower end when it is fastened to the roof, at least one hinge aperture for the reception of a hinge pin to form a hinge pivotable about a hinge axis parallel to the eave;

an elongated support member which when the structure member is installed extends vertically above and below the eave, the support member having at a junction portion thereof along its length at least one hinge aperture cooperating with the roof cleat hinge aperture and the hinge pin to form said hinge;

the portion of the support member which when it is installed extends below the eave being a shorter portion thereof, and having thereon a generally horizontally extending member engagable with the building structure below the roof line, for example with a rafter tail (the end of a rafter) or with the fascia board, to retain the support member in a vertical attitude;

the portion of the support member which when it is installed extends above the eave being a longer portion thereof, and comprising when so installed an outward upward inclined shorter part extending from the junction portion, and a vertical longer part extending from the inclined shorter part to the end of the longer portion;

a toe board retainer member mounted on the inclined shorter part for retention thereon in an inclined attitude of a horizontally extending toe board; and at least two back rail support members mounted on the vertical longer part for retention of respective horizontally extending elongated back rail supports thereon.

Also in accordance with the invention there is provided a building roof eave mounting guard structure for installation at the edge of a building roof eave comprising:

a plurality of horizontally spaced roof cleats, each as specified in the preceding paragraph;

a corresponding plurality of horizontally spaced elongated support members, one for each roof cleat, and each as specified in the preceding paragraph;

a horizontally extending inclined toe board mounted thereon; and at least two back rail support members mounted thereon.

The structure member may comprise a catch board retainer member mounted on the vertical longer part adjacent to the inclined shorter part for retention thereon in a vertical attitude of a horizontally extending catch board, whereby the toe and catch boards can cooperate together to provide a catch space for debris. Such a catch board retainer member may be mounted for longitudinal movement for adjustment to accommodate catch boards of different widths, and it may accommodate two catch boards placed face-to-face to permit overlap of end junctions between two immediately succeeding boards.

The toe board retainer member may be mounted for longitudinal movement for adjustment to accommodate toe boards of different widths, and the member may accommodate two toe boards placed face-to-face to permit overlap of end junctions between two immediately succeeding adjacent boards.

Each support member may comprise a safety strap retainer member mounted on the underside of the shorter portion, this member receiving a metal safety strap that extends longitudinally beneath a respective toe board for engagement by the toe board upon any excessive sag thereof downward.

The member engagable with the building wall may be of adjustable length for adjustment of the vertical attitude of the support member, and it may terminate in a pressure pad of increased surface area engaging the building structure (e.g. rafter tail), being connected to the pressure pad by a hinge pivotal about an axis parallel to the eave.

Each back rail support member may be a closed loop member in which the elongated back rail support is inserted endwise, and each loop member may accommodate two elongated back rail supports placed face-to-face to permit overlap of end junctions between two immediately succeeding supports.

DESCRIPTION OF THE DRAWINGS

Building roof eave mounted catch and guard structures which are particular preferred embodiments of the invention will now be described, by way of example, with reference to the accompanying diagrammatic drawings, wherein.

DESCRIPTION OF THE PREFERRED EMBODIMENTS

Figure 1:
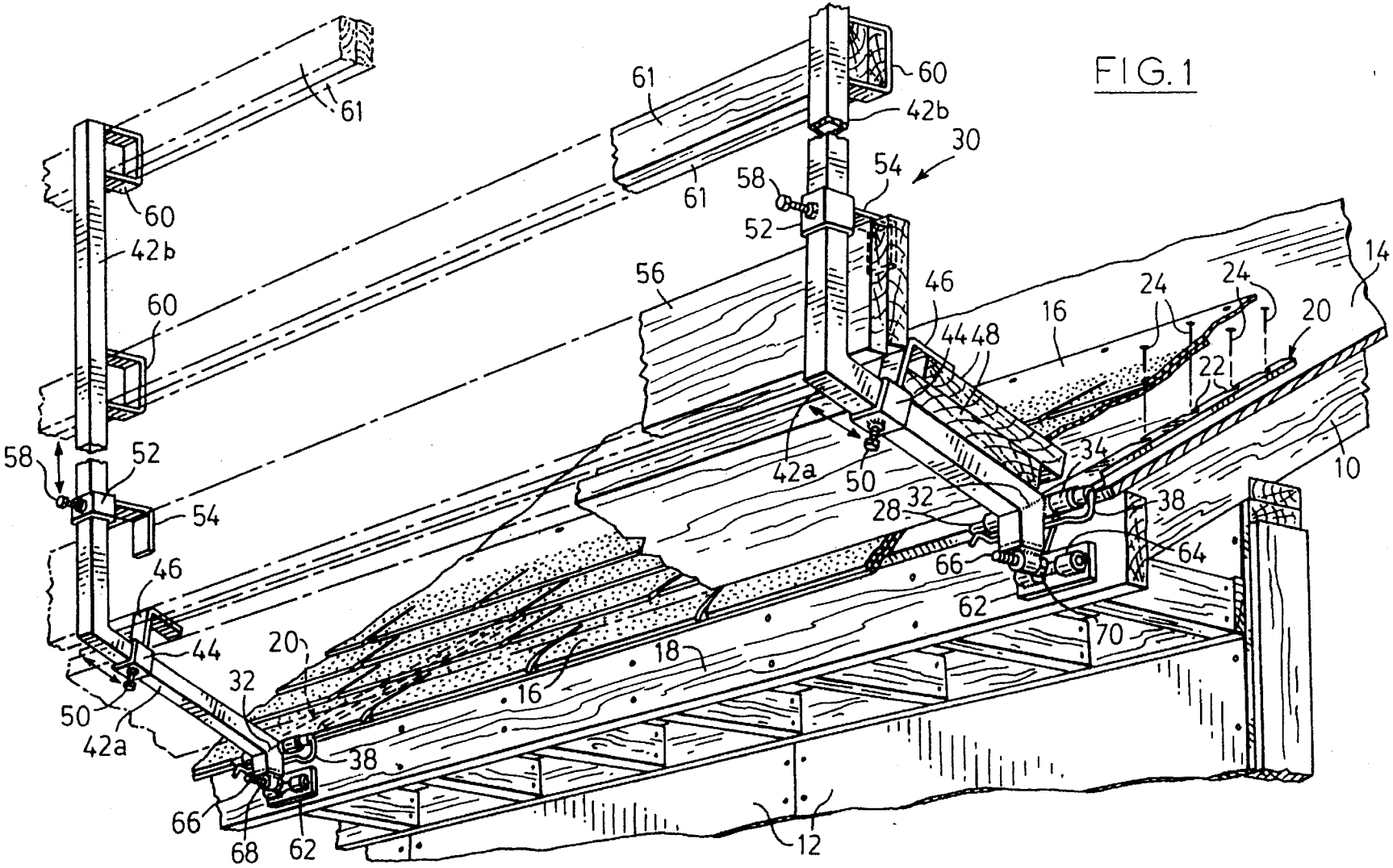
FIG. 1 is a perspective view from below and to one side showing a structure mounted at the edge of a building roof eave, parts thereof being shown exploded and broken away as necessary for better illustration.
Figure 2:
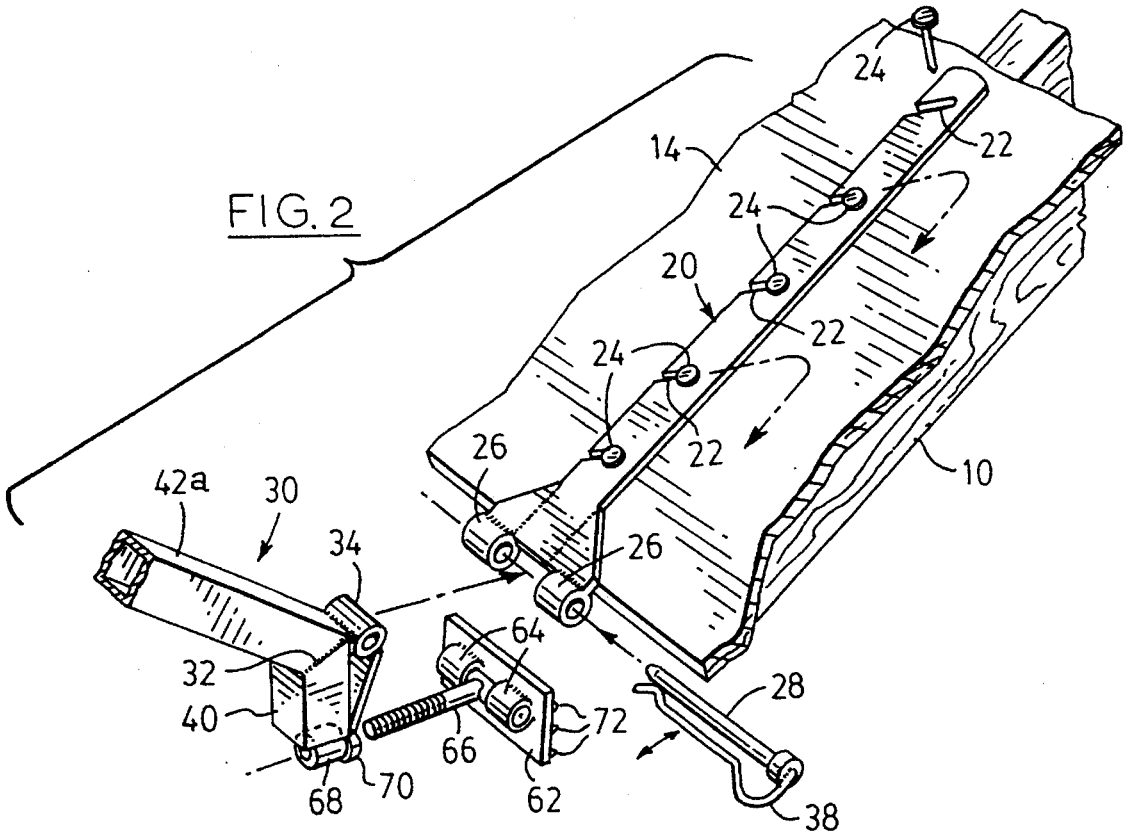
FIG. 2 is an exploded perspective view from above of a cleat and adjacent portion of a support member to illustrate in more detail the mode of attachment of the structure to the roof.

FIG. 1 illustrates a conventional wood frame roof construction comprising spaced rafter frames 10, the horizontally extending lower members of which protrude beyond the vertical building wall 12 on which they rest. The outer ends of these lower members are commonly referred to as the rafter tails. The sloping members of the frames are covered with wooden roof sheathing 14, moisture resistant building paper sheathing (not shown), and overlapping rows of shingles 16. A fascia board 18 is fastened to the outer ends of the rafter frames, while the spaces between the protruding ends are closed by soffit sheathing (also not shown). The usual procedure is to lay a single row of a double layer of shingles at the extreme lower edge of the roof, and thereafter to lay successive rows of single layers.

In using the structure members and the structures of the invention the first step is to attach a plurality of horizontally spaced roof cleats 20 to the roof, each of which comprises a flat elongated metal plate of appropriate thickness. Each cleat is provided with a plurality (five in this embodiment) of parallel downward inclined spike or nail receiving slots 22 that will permit ready removal of the cleat at the end of the process by moving it upward, as will be described below. Preferably these cleats are attached at locations along the roof where the headed attaching nails 24 will pass through the sheathing 14 into the rafters to maximize their holding power; for the same purpose the maximum possible number of nails may be used. The slots 22 are alternately shorter and longer in length so that the nails can be set in a staggered lengthwise pattern. The longer large headed spiral galvanised nails normally used for roofing will usually be satisfactory, especially since the load on the nails is virtually solely in shear. If an established roof is to be reshingled the shingles are torn away at the selected locations so that the cleats can be nailed directly onto the sheathing 14. The first row of shingles is then nailed down over the top of the cleats.

Each cleat is provided at its lower end with a pair of spaced hinge parts 26 providing coaxial horizontal passages receiving a hinge pin 28 to form a corresponding hinge having its hinge axis parallel and close to the roof edge or eave. Each roof cleat is used together with an elongated support member, indicated generally by the arrowed reference 30, each support member having at an intermediate junction portion 32 thereof a hinge part 34 that cooperates with the parts 26 and pin 28 to form the hinge. The hinge part 34 is welded to the support member with a strengthening gusset 36, and a pin retainer 38 is provided to ensure that the pin cannot accidentally be withdrawn from the hinge.

The support member 30 has a shorter portion 40 extending below the roof cave, and a much longer portion extending above the roof eave, this longer portion comprising a shorter part **42*a* extending from the junction portion and inclined outward and upward at a suitable shallow angle to the horizontal, and a vertically extending longer part 42*b* extending from the inclined portion. The inclined shorter part 42*a* has a sleeve 44 mounted thereon for sliding movement towards and away from the roof, this sleeve carrying a toe board retainer 46 that engages around the adjacent edges of a pair of horizontally extending cooperating toe boards 48 against which the roofer's feet can be braced. This sliding mounting of the retainer permits its adjustment to receive and retain boards of different widths, in accordance with the roofer's preference or availability. Also the size of the retainer is such that it can accommodate two wood boards of standard nominal thickness dimension face-to-face, for example 5 cm (2 ins) thick, so that the joints between immediately successive boards can be overlapped. Once the toe boards are placed in position the retainers are held in place by respective clamp screws 50**.

In this embodiment the vertically extending part **42*b* has a similar sleeve 52 mounted thereon for vertical sliding movement, this sleeve carrying a catch board retainer 54 that engages around the adjacent edges of a pair of cooperating horizontally extending catch boards 56 which can butt against the toe boards and cooperate with them to form a horizontally extending catch space into which debris, such as discarded shingles, shingle parts, building paper, and nails can fall and will be retained against falling to the ground until they are removed for disposal. As with the toe board retainer its adjustable mounting permits it to accommodate boards of different standard nominal width dimension face-to-face, of width decided by the roofer, while its size permits it to accommodate boards of different standard nominal thickness dimension face-to-face, so that again the joints between immediately successive boards can be overlapped. Moreover, the retainer allows the two boards to slide in their face-to-face engagement so that they can more fully close the wedge-shaped gap between the vertical part 42***b* and the adjacent edges of the toe boards. Once the boards are in position the retainers are held securely in place by respective screws 58.

The upper end of the part 42*b* is provided with two vertically spaced outwardly extending back rail support members 60 consisting of closed metal loops welded to the part; each loop receives a pair of horizontally extending back support boards 61 that are threaded endwise through the loops. As with the toe and catch board retainers the loop sizes permit them to receive two wood boards of standard dimensions face-to-face, for example nominal 5 cm by 10 cm (2 ins by 4 ins), so that again the joints between immediately successive boards can be overlapped. It is a requirement in a number of building safety codes to provide at least two such vertically spaced back supports, so that the use of less than two is unlikely, while more than two can of course be provided.

In a basic particularly economical structure only a toe board and the back rails are provided, but it will be seen that in this embodiment comprising a catch board and two vertically spaced back boards they cooperate with one another to provide a very effective safety barrier against falling from the roof in case the roofer should slip, with a structure that is otherwise relatively simple and inexpensive to manufacture, and simple, fast and inexpensive to install.

With this embodiment, once each support member is attached to its respective cleat, if the support member is too much out of vertical it can be moved to a sufficiently vertical attitude by operation of an adjusting assembly comprising a pressure plate 62 having hinge pin housings 64 on its outer face, these housings receiving the head of a T-shaped horizontally extending member 66, the head comprising a hinge pin so that the member is hinged to the plate about a horizontal hinge axis. The foot of the member 66 is screw-threaded and passes through a housing 68 attached securely to the bottom end of the shorter part 42*a*, and an adjusting nut 70 is fastened to the inner end of the housing 68, for example by welding. The pressure plate 68 butts against the fascia board 18, and with the cleats in their preferred locations nailed through into the rafters each pressure plate will, as illustrated, automatically be located in its preferred position at the respective rafter tail. The inclination of the support member to the vertical is adjusted by adjustment of the effective length of the foot of the member 66, and in this embodiment this is done by rotating the pressure plate and the attached T-shaped member in the appropriate direction in the fixed nut 70.

The face of the pressure plate that butts against the building structure is provided with a plurality of spaced, parallel ridges 72 that are usually positioned to be at least approximately horizontal, so that they can assist in preventing slippage due to any outward force on the upper part of the support member. Even with a pressure plate it is preferred that the plate contacts the building structure at or as close as possible to a respective rafter tail, and the use of a pressure plate is preferred because of the relatively long leverage resulting from the substantial difference in lengths between the parts of the support member above and below the roof line. The hinge accommodates the resulting changes in the engagement of the plate with the T-shaped member 66. With this adjustment made and all of the parts of the structure in place the roofer is able to proceed with stripping shingles from the roof, and/or placing new shingles, with the knowledge that debris will not easily fall to the ground, and that an excellent safety structure has also been provided in case of an accidental fall or downward slide on the roof.

In a more basic structure, such as the one described above, in order to reduce cost an adjustment assembly is not provided and the pressure plate is attached fixedly to the shorter part 42*a*, the roofer depending upon suitable location of the cleat member and the hinge axis in relation to the roof edge for the structure to be sufficiently upright; in practice a small deviation from the truly vertical in either direction is tolerable.

At the conclusion of the job the structure is easily disassembled by removing the toe, catch and back boards and then the hinge pins 28. As with its assembly, because of the relatively small and convenient size of its parts, as compared for example with ladders or ground mounted scaffolding, they are easily handled and stored. The cleats 20 are readily removed by pushing them upwards, hammering them if necessary, when the nails slide in the inclined slots 22 until the cleats are free of them; the cleats can then be slid out from beneath the shingles and, if desired, the nails further hammered down into the roof sheathing.

In a particular preferred embodiment the cleats are of mild steel of 4.75 mm thickness (0.187 in), are 30 cm (12 in) in length and are 3.8 cm (1.5 in) wide at the slotted part and 12.5 cm (5 ins) wide at the hinge part. The hinge pin is forged and is about 16 cm (6.25 ins) length and 1.4 cm (0.56 in) diameter. The support member is of H.S.S. seamless square cross section steel tube of side 10 cm (2.5 ins). The shorter support portion 40 is of about 8.2 cm (3.25 ins) length, while the pressure pad measures 3 ins by 1.5 in (7.5 cm by 3.75 cm). The shorter upper part 42*a* is 31.25 cm long (12.5 ins); the overall length of the upper portion 42*b* is 97.5 cm (39 ins) and the distance between the two back rail support members 60 is 40 cm (16 ins).

Figure 3:
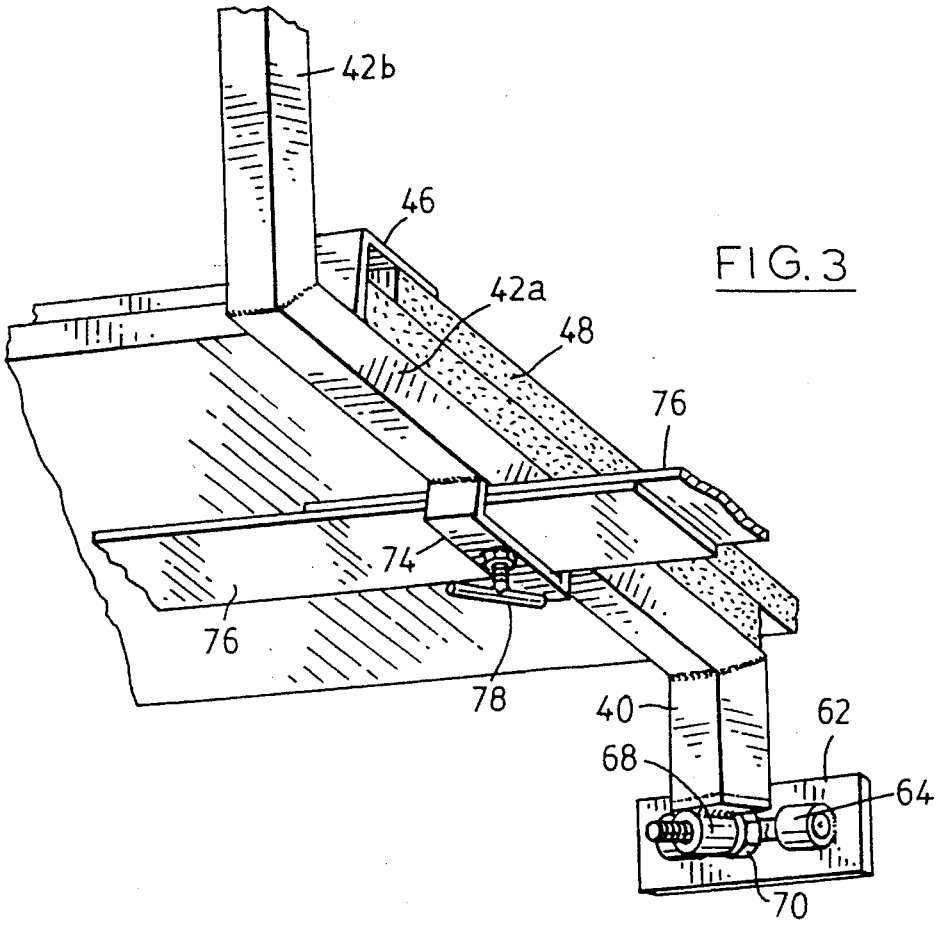
FIG. 3 is a perspective view similar to FIG. 1, of a part of a structure which is another embodiment of the invention.

The embodiment illustrated by FIG. 3 is intended for use with toe boards 48 of standard width, and accordingly the toe board retainer 46 is not adjustable and is welded in place. For maximum safety the toe boards 48 should be of new or nearly new structural grade lumber, but there is the possibility that the roofer will instead use any lumber that is readily available, which may not be of adequate grade and/or may have become weakened by aging, weathering and use.

This embodiment takes account of this possibility by the provision on the underside of the shorter part 42*a* of a metal U-shaped bracket 74, welded to the part, comprising a safety strap retainer member which can receive two overlapping bridging safety straps 76 that extend lengthwise beneath the toe boards. If for any reason a toe board cracks or otherwise sags downward excessively it engages the respective safety strap and cannot break catastrophically. When the spacing of the adjacent support members has been set and the straps are in position with the necessary overlap they are secured against lengthwise movement by a clamp screw 78. A suitable material for the safety straps is, for example, mild steel of 4.7 mm (0.187 in) thickness and 3.75 cm (1.5 in) width.

I claim:

1. A building roof eave mounting guard structure member for installation at the edge of a building roof eave comprising:

a roof cleat comprising a flat metal plate removably fastenable to the roof, the plate having a plurality of nail receiving apertures therein through which upon installation of the guard structure nails are passed for such removable fastening to the roof;

a hinge pin;

the roof cleat having at its end that is its lower end when it is fastened to the roof, at least one hinge aperture for the reception of the hinge pin to form a hinge pivotable about a hinge axis parallel to the eave;

an elongated support member which when the guard structure member is installed has a longer portion that extends vertically above the eave and a shorter portion that extends vertically below the eave, the longer and shorter portions having between them a junction portion including at least one hinge aperture cooperating with the roof cleat hinge aperture and the hinge pin to form said hinge;

the support member shorter portion having thereon a generally horizontally extending building structure engaging member engagable with the building structure below the roof line to retain the support member in a vertical attitude;

the support member longer portion comprising when so installed an outward upward inclined shorter part extending from the junction portion, and a vertical longer part extending from the inclined shorter part to the end of the longer portion;

a toe board retainer member mounted on the inclined shorter part for retention thereon, when the guard structure member is installed, of a horizontally extending toe board; and at least two vertically spaced back rail support members mounted on the vertical longer part for retention, when the guard structure member is installed, of respective horizontally extending elongated back rail supports thereon.

2. A guard structure member as claimed in claim 1, and comprising a catch board retainer member mounted on the vertical longer part adjacent to the inclined shorter part for retention thereon, when the guard structure member is installed, in a vertical attitude of a horizontally extending catch board, whereby the toe and catch boards when retained thereon can cooperate together to provide a catch space for debris.

3. A guard structure member as claimed in claim 2, wherein the catch board retainer member is mounted on the vertical longer part for movement therealong for adjustment to retain thereon catch boards of different widths.

4. A guard structure member as claimed in claim 3, wherein the catch board retainer member retains two catch boards placed face-to-face to permit overlap of end junctions between two immediately succeeding boards.

5. A guard structure member as claimed in claim 1, wherein the toe board retainer member is mounted on the vertical longer part for movement therealong for adjustment to retain toe boards of different widths.

6. A guard structure member as claimed in claim 5, wherein the toe board retainer member retains two toe boards placed face-to-face to permit overlap of end junctions between two immediately succeeding adjacent boards.

7. A guard structure member as claimed in claim 1, and comprising a safety strap retainer member mounted on the underside of the support member shorter portion, the safety strap retainer member receiving, when the guard structure member is installed, a metal safety strap so as to extend beneath a respective toe board for engagement by the toe board upon sag thereof downward.

8. A guard structure member as claimed in claim 1, wherein the building structure engaging member is of adjustable length for adjustment of the vertical attitude of the support member.

9. A guard structure member as claimed in claim 8, wherein the building structure engaging member terminates in a pressure pad of increased surface area connected to the pressure pad by a hinge pivotal about an axis, the pressure pad engaging the building structure when the guard structure member is installed with the hinge pivotal about the axis parallel to the eave.

10. A guard structure member as claimed in claim 1, wherein each back rail support member is a closed loop member in which, when the guard structure member is installed, an elongated back rail support is inserted endwise, and each loop member is of a size to accommodate two back rail supports placed face-to-face to permit overlap of end junctions between two immediately succeeding back rail supports.

11. A building roof eave mounting guard structure for installation at the edge of a building roof eave comprising:

a plurality of horizontally spaced roof cleats, each comprising a flat metal plate removably fastenable to the roof, each plate having a plurality of nail receiving apertures therein through which upon installation of the guard structure nails are passed for such removable fastening to the roof;

a plurality of hinge pins, one for each roof cleat;

each roof cleat having at its end that is its lower end when it is fastened to the roof, at least one hinge aperture for the reception of the respective hinge pin to form a respective hinge pivotable about a hinge axis parallel to the eave;

a corresponding plurality of horizontally spaced elongated guard support members, one for each roof cleat, and each of which when the respective structure member is installed has a longer portion that extends vertically above the eave and a shorter portion that extends vertically below the eave;

each guard support member having a junction portion thereof between its longer and shorter portions, each junction portion including at least one hinge aperture cooperating with the respective roof cleat hinge aperture and hinge pin to form said hinge;

each guard support member shorter portion having thereon a generally horizontally extending building structure engaging member engagable with the building structure below the roof line to retain the guard support member in a vertical attitude;

each guard support member longer portion comprising when so installed an outward upward inclined shorter part extending from the junction portion, and a vertical longer part extending from the inclined shorter part to the end of the longer portion;

a respective toe board retainer member mounted on the inclined shorter part of each guard support member for retention thereon, when the guard structure is installed, a horizontally extending toe board; and at least two vertically spaced back rail support members mounted on the vertical longer part of each guard support member for retention, when the guard structure is installed, of respective horizontally extending elongated back rail supports thereon.

12. A guard structure as claimed in claim 11, and comprising for each guard support member a catch board retainer member mounted on the vertical longer part thereof adjacent to the inclined shorter part for retention thereon, when the guard structure is installed, in a vertical attitude of a horizontally extending catch board, whereby the toe and catch boards when retained thereon can cooperate together to provide a catch space for debris.

13. A guard structure as claimed in claim 12, wherein each catch board retainer member is mounted on the respective structure member longer part for movement therealong for adjustment to retain thereon catch boards of different widths.

14. A guard structure as claimed in claim 13, wherein each catch board retainer member retains two catch boards placed face-to-face to permit overlap of end junctions between two immediately succeeding boards.

15. A guard structure as claimed in claim 11, wherein each toe board retainer member is mounted on its respective guard support member longer part for movement therealong for retention of toe boards of different widths.

16. A guard structure as claimed in claim 15, wherein the toe board retainer member retains two toe boards placed face-to-face to permit overlap of end junctions between two immediately succeeding adjacent boards.

17. A guard structure as claimed in claim 11, and comprising for each guard support member a safety strap retainer member mounted on the underside of the guard support member shorter portion, the safety strap retainer member receiving, when the guard structure is installed, a metal safety strap so as to extend beneath a respective toe board for engagement by the toe board upon sag thereof downward.

18. A guard structure as claimed in claim 11, wherein each building structure engaging member of each guard support member is of adjustable length for adjustment of the vertical attitude of the respective guard support member.

19. A guard structure as claimed in claim 18, wherein each building structure engaging member terminates in a respective pressure pad of increased surface area connected to the pressure pad by a hinge pivotal about an axis, each pressure pad engaging the building structure when the guard structure is installed with the respective hinge pivotal about the respective axis parallel to the eave.

20. A guard structure as claimed in claim 11, wherein each back rail support member is a closed loop member in which, when the guard structure is installed, a respective elongated back rail support is inserted endwise, and each loop member is of a size to accommodate two back rail supports placed face-to-face to permit overlap of end junctions between two immediately succeeding back rail supports.

* * * * *